US010046838B1

(12) United States Patent
Chaifetz

(10) Patent No.: US 10,046,838 B1
(45) Date of Patent: Aug. 14, 2018

(54) SUPSKI PADDLE SYSTEM

(71) Applicant: Guy Chaifetz, North Port, FL (US)

(72) Inventor: Guy Chaifetz, North Port, FL (US)

( * ) Notice: Subject to any disclaimer, the term of this patent is extended or adjusted under 35 U.S.C. 154(b) by 0 days.

(21) Appl. No.: 15/811,092

(22) Filed: Nov. 13, 2017

(51) Int. Cl.
*B63B 35/79* (2006.01)
*B63H 16/02* (2006.01)
*B63B 35/85* (2006.01)

(52) U.S. Cl.
CPC ..... *B63B 35/7926* (2013.01); *B63B 35/79* (2013.01); *B63H 16/02* (2013.01); *B63B 35/85* (2013.01); *B63B 2754/00* (2013.01)

(58) Field of Classification Search
CPC ..... B63B 35/79; B63B 35/85; B63B 35/7906; B63B 35/7926; B63H 1/00; B63H 1/36; B63H 16/00; B63H 16/02; B63H 16/10; B63H 16/12; B63H 16/18
USPC ..... 440/21, 25; 441/74
See application file for complete search history.

(56) References Cited

U.S. PATENT DOCUMENTS 3,593,356 A * 7/1971 Schmalfeldt ..... B63B 35/7936 441/74
5,163,857 A * 11/1992 Hinsley ..... B63H 1/36 440/25
8,590,478 B2 * 11/2013 Lipman ..... B63B 35/79 114/347
2009/0104828 A1 * 4/2009 Krah ..... B63H 1/36 441/74
2015/0314847 A1 * 11/2015 La Rovere ..... B63H 16/18 440/25

* cited by examiner

*Primary Examiner* — Lars A Olson
(74) *Attorney, Agent, or Firm* — Tiffany C. Miller; Inventions International Inc.

(57) ABSTRACT

A paddle board has two tracks integrally associated therewith for the further attachment of a slide within each track thereon. Thus, to effect motion of the slide associated with the track the Supski Paddle System has two actuation drives that are rotationally associated with the aforementioned slides one to each slide respectively. Upon user actuation of the drive using a pole associated with the drive the slide is directed to move longitudinally upon a track or to insert a paddle into and out of the water.

6 Claims, 21 Drawing Sheets

1
2
3

2
3
4
1
6
6

4
5

Fig. 2A
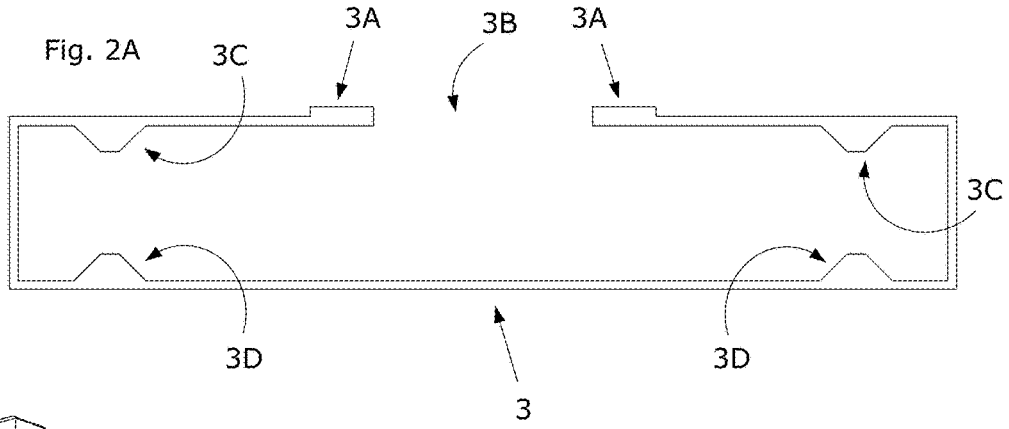
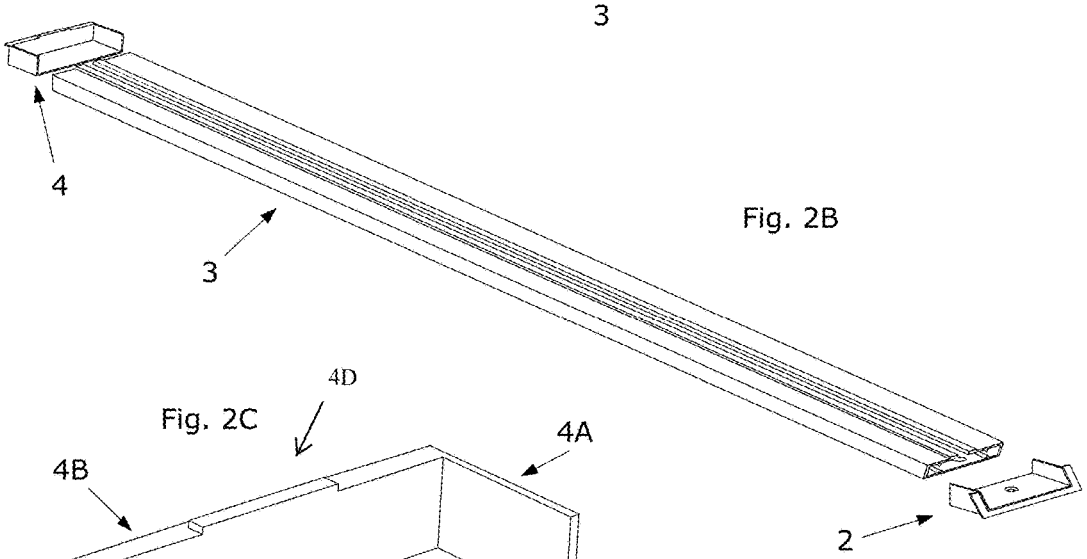
Fig. 2B
Fig. 2C
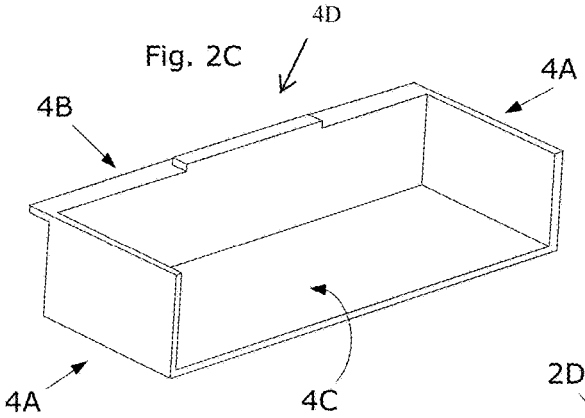
Fig. 2D
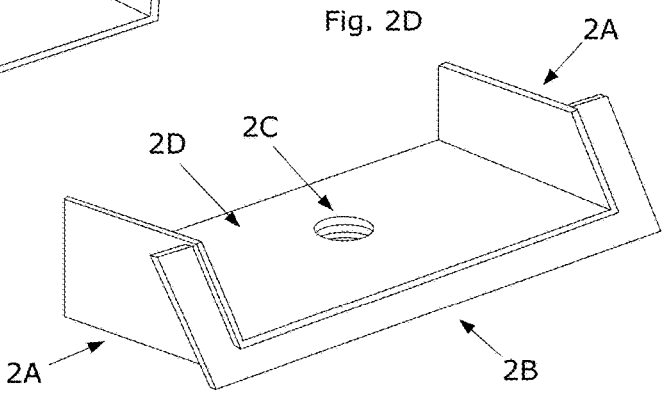

SUPSKI PADDLE SYSTEM

FIELD OF THE INVENTION

The present invention relates to a recreational device. More particularly, the present invention relates to a recreational device that is designed to be used on the top surface of water at a river, beach, bay, harbor, lake or similar water source.

BACKGROUND OF THE INVENTION

People are naturally drawn to water sports and various types of equipment have been designed to facilitate the enjoyment of this environment. Whether exercising in an waterborne volleyball game within a pool, paragliding at the ocean or similar venue or riding a jet ski users have found novel ways to enjoy the water. Thus, it can be appreciated that both simple mechanical devices as well as motorized devices have been presented to users for enjoyment and the rewards of vigorous exercise.

Gymnasiums usually provide the option of using a mechanical or electromechanical system that simulates skiing on land. Typically a large flat surface representing the ski is provided attached to appropriate handles disposed at arms length. The flat surface is also attached to a rotating wheel providing the axis upon which a user can effect the forward and backward motions of the ski. This represents a very good workout for those who use this system within a gymnasium environment.

Additionally, users have become more and more inclined to using a paddle board system. Typically, a board is a longitudinal device made from a suitable foam material and have a center area upon which a user rides sitting in a seat or standing up. Some boards come with a rubber insert to help users maintain foot gripping action thereupon. Whilst sitting in a seat integrated on the board or standing up on the board a user actuates a paddle independent from the board to translate the board forward, backwards, right or left using appropriate rowing strokes. A problem arises, however, in that no system has been created that helps weaker users perform the stroking motions whilst using a typical paddle board on the water itself. Nor has there been a solution that helps performance users extend their time aboard the paddle board by assisting in the aforementioned stroking actions thereby lessening the amount of energy for both novice and experienced athletes.

Accordingly, there needs to be some solution to overcome the aforementioned problems.

SUMMARY OF THE INVENTION

The present invention overcomes the deficiencies of the known art and the problems that remain unsolved by providing:

An exercise system comprising:

a paddle board having a track attached thereto wherein the track has an integral longitudinal protrusion running down an inside surface of the track.

In another aspect, wherein the longitudinal protrusion is disposed on an inside upper surface of the track.

In another aspect, wherein the longitudinal protrusion is disposed on an inside lower surface of the track.

In another aspect, wherein there is a second longitudinal protrusion disposed on an inside surface of the track.

In another aspect, wherein the longitudinal protrusion is associated with a groove in a slide inserted within the track.

In another aspect, further comprising:

a slide inserted within the track such that a laterally disposed mount integral with the slide has a groove associated with the longitudinal protrusion.

In another aspect, further comprising:

an axle associated with the track.

In another aspect, further comprising:

a pivot associated with the track.

In another aspect, further comprising:

a paddle drive associated with the track.

In another aspect, further comprising:

a paddle drive associated with the track and mounted on a slide inserted in the track.

In another aspect, further comprising:

a paddle attached to the paddle drive.

In another aspect, further comprising:

a pole attached to the paddle drive.

In another aspect, further comprising:

an actuation spring attached to the paddle drive.

A paddle board assembly comprising:

a track integrally formed from a board having a lengthwise first node running down a recessed inner surface.

In another aspect, further comprising:

a slide inserted within the track having a first integral lateral mounting protrusion.

In another aspect, further comprising:

a first depression in the first integral lateral mounting protrusion associated with and matching the lengthwise first node of the recessed inner surface of the track.

In another aspect, wherein the slide further comprises:

a lengthwise second node running down a recessed inner surface parallel to the first node.

In another aspect, further comprising:

the slide having a second integral lateral mounting protrusion having a second depression associated with and matching the lengthwise second node of the recessed inner surface of the track.

In another aspect, further comprising:

a paddle drive rotationally attached to a slide;

a pole attached to the paddle drive;

a paddle attached to the paddle drive;

a spring attached to the paddle drive and to the slide.

An activity paddle board comprising:

a board loaded with a first track; such that the first track has a first slide mounted therein using at least two lateral mounts atop a first and a second raised portion of the first track respectively;

a paddle attached to the first slide through a rotational member associated with the slide and a pole.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which:

FIG. 2A presents a front view of a track utilized in a Supski Paddle System as taught in an embodiment disclosed herein. FIG. 2B presents a perspective view of a track system used in Supski Paddle System as taught in an embodiment disclosed herein. FIG. 2C presents a front end cap used in Supski Paddle System as taught in an embodiment disclosed herein. FIG. 2D presents a rear end cap used in Supski Paddle System as taught in an embodiment disclosed herein.

FIG. 5J shows a left turn whilst FIG. 5K shows a right turn.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The Supski Paddle System comprises various components as disclosed below including but not limited to: a paddle board having dual channels, dual longitudinal rectangular tracks, dual sets of front and rear end caps, dual stops, two paddles, two poles, two slides, and dual actuator as follows. The Supski Paddle System has two tracks within which one of the dual set of slides rides; each slide is attached to an actuator that itself is attached to a paddle and a pole. Various user hand motions are communicated via the pole through the paddle drive mounted to the slide and on into the paddle.

These motions cause spring action of the paddle to move the board forwards, backwards, engage the paddles into and out of the water and so forth.

Figures 1A, 1B, 1C:
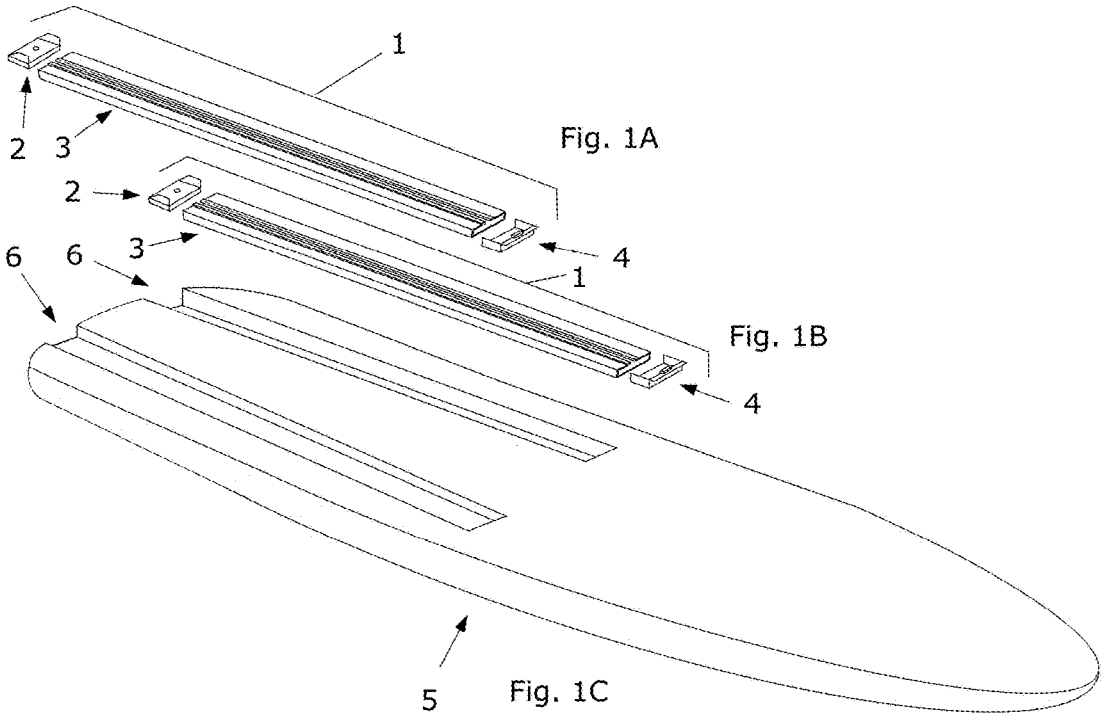
FIG. 1A presents a view of a first track system used in Supski Paddle System as taught in an embodiment disclosed herein.
FIG. 1B presents a view of a second track system used in Supski Paddle System as taught in an embodiment disclosed herein.
FIG. 1C presents a view of the board used in Supski Paddle System as taught in an embodiment disclosed herein.

FIG. 1A presents a view of a first track system used in Supski Paddle System as taught in an embodiment disclosed herein. A first track system 1 has a rear end cap 2, a longitudinal rectangular track 3, and a front end cap 4 useable together. The first track system 1 is designed to sit within a channel 6 shown in FIG. 1C along a portion of the paddle board 5. The rear end cap 2 is cemented to the rear end of the longitudinal rectangular track 3 and its design permits the track 3 to be open at this rear end. The track 3 rear end abuts and or sits between two raised walls on either side of the rear end cap 2 so that the bottom of the track 3 sits atop a main surface of rear end cap 2. This disposition allows for removal of the slide shown in other figures thereby facilitating the packing and portability of the overall Supski Paddle System. Also, the rear end cap 2 has a flange on it that is covered with fiberglass during the manufacturing process and provides a watertight seal between the track and the paddle board. It also has a threaded anchor hole embedded in it to allow for the track to be secured at this end.

A front end cap 4 is cemented to the front end of the track 3 providing a water tight seal when the track is embedded under fiberglass; it also has a flange on it that is covered by fiberglass as needed. The bottom of the front end of the track 3 therefore sits atop a primary surface of the front end cap 4 such that a forward portion of the front end track 3 abuts a back portion of the front end cap 4; this while the front side portions of the front end of the track 3 abuts and or sits between two raised surfaces on either side of the front end cap 4.

It should be apparent that since their are dual longitudinal rectangular tracks 3, that what happened with the first track system 2, 3, 4 is now repeated with regards to the other second track system 2, 3, 4.

FIG. 1B presents a view of a second track system used in Supski Paddle System as taught in an embodiment disclosed herein. It should be apparent that since their are dual longitudinal rectangular tracks 3, that what happened with the first track system 2, 3, 4 is now repeated with regards to the other second track system 2, 3, 4 in the second channel 6.

FIG. 1C presents a view of the board used in Supski Paddle System as taught in an embodiment disclosed herein. This view shows two channels 6 that are essentially cutouts or preformed ditches that run along a portion of the length of the paddle board 5 and end such that there are two openings at the end thereof. These channels 6 are slots that have been cutout of the foam inner core of a paddle board. The first and second track systems 1 are positioned in the respective channels 6 and a fiber glass overlay is applied over the track 3 and end caps 2, 4 up to a longitudinal slot for the slide; this process continues until the track systems 1 are firmly in place. Once a fiberglass overlay has covered the components the only portion of the track 2 that is visible is a longitudinal slot present in each track 3 for one of the dual slides as taught below. The rear end of the board 5 where the channels 6 end is open so as to facilitate the removal of the slide taught below for easy portability.

FIG. 2A presents a front view of a track utilized in a Supski Paddle System as taught in an embodiment disclosed herein. The track 3 is shown having various features as described in the following. There are two small flanges 3A running lengthwise down the top of the track 3; this track 3 is a rectangular longitudinal member also having a longitudinal slot 3B running down its centerline between the flanges 3A so that a neck of a slide rides therein. This slide, discussed in subsequent figures, has indentations on portions thereof that ride upon raised longitudinal protrusions known as nodes 3C, 3D. These longitudinal nodes are located on an inner upper and lower surfaces of the track 3 having two top nodes 3C and two bottom nodes 3D; whilst the nodes 3C, 3D are shown optimally as a frustum or triangular shape other shapes will do as long as they permit the flow of the slide thereupon.

FIG. 2B presents a perspective view of a track system used in Supski Paddle System as taught in an embodiment disclosed herein. A first track system 1 has a rear end cap 2, a longitudinal rectangular track 3, and a front end cap 4 useable together. The first track system 1 is designed to sit within a cutout slot or channel 6 shown in FIG. 1C along a portion of the paddle board 5. The rear end cap 2 is cemented to the rear end of the longitudinal rectangular track 3 and its design permits the track 3 to be open at this rear end. The track 3 rear end abuts and or sits between two raised walls on either side of the rear end cap 2 so that the bottom of the track 3 sits atop a main surface of rear end cap 2. This disposition allows for removal of the slide shown in other figures thereby facilitating the packing and portability of the overall Supski Paddle System. Also, the rear end cap 2 has a flange on it that is covered with fiberglass during the manufacturing process and provides a watertight seal between the track and the paddle board. It also has a threaded anchor hole embedded in it to allow for the track to be secured at this end.

A front end cap 4 is cemented to the front end of the track 3 providing a water tight seal when the track is embedded; it also has a flange on it that is covered by fiberglass as needed. The bottom of the front end of the track 3 therefore sits atop a primary surface of the front end cap 4 such that a forward portion of the front end track 3 abuts a back portion of the front end cap 4; this while the front side portions of the front end of the track 3 abuts and or sits between two raised surfaces on either side of the front end cap 4.

It should be apparent that since their are dual longitudinal rectangular tracks 3, that what happened with the first track system 2, 3, 4 is now repeated with regards to the other second track system 2, 3, 4 with a second channel 6.

FIG. 2C presents a front end cap used in Supski Paddle System as taught in an embodiment disclosed herein. A front end cap 4 has two raised surfaces 4A integral on edges with corresponding edges of a forward wall 4B. The two raised surfaces 4A and the forward wall integrate along respective lower edges thereof with a primary surface 4C. The front end cap 4 is cemented to the front end of the track 3 providing a water tight seal when the track is embedded; it also has a forward flange 4D on a forward wall 4B that is covered by fiberglass as needed. The bottom of the front end of the track 3 therefore sits atop a primary surface 4C of the front end cap 4 such that a forward portion of the front end track 3 abuts a forward wall 4B of the front end cap 4; this while the front side portions of the front end of the track 3 abuts and or sits between two raised surfaces 4A on either side of the front end cap 4.

FIG. 2D presents a rear end cap used in Supski Paddle System as taught in an embodiment disclosed herein. The rear end cap 2 is cemented to the rear end of the longitudinal rectangular track 3 and its design permits the track 3 to be open at this rear end. The track 3 rear end abuts and or sits between two raised walls 2A on either side of the rear end cap 2 so that the bottom of the track 3 sits atop a main surface 2D of rear end cap 2. This disposition allows for removal of the slide shown in other figures thereby facilitating the packing and portability of the overall Supski Paddle System. Also, the rear end cap 2 has a rear U shaped flange 2B integral therewith that is covered with fiberglass during the manufacturing process and provides a watertight seal between the track and the paddle board. It also has a threaded anchor hole 2C embedded in it to allow for the track to be secured at this end.

Figure 3A:
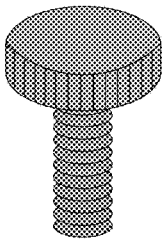
FIG. 3A presents a view of a screw utilized in a Supski Paddle System as taught in an embodiment disclosed herein.

FIG. 3A presents a view of a screw utilized in a Supski Paddle System as taught in an embodiment disclosed herein.

Figure 3B:
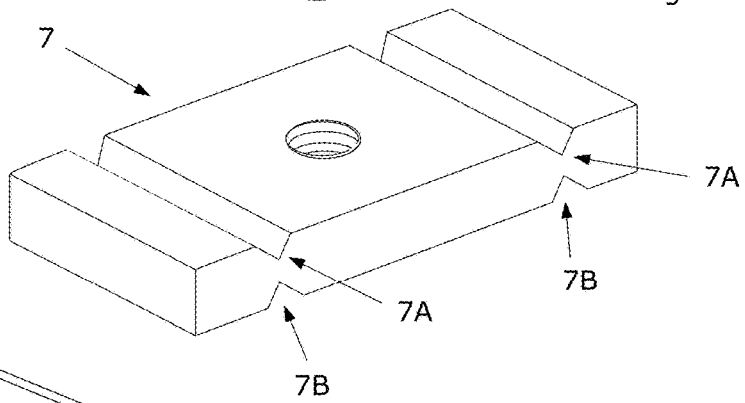
FIG. 3B presents a view of a stop utilized in Supski Paddle System as taught in an embodiment disclosed herein.

FIG. 3B presents a view of a stop utilized in Supski Paddle System as taught in an embodiment disclosed herein. The stop 7 is a removable generally rectangular shaped piece of material that is to be inserted within the track 3 atop a concentrically located hole in the track 3 for engagement with the screw shown in FIG. 3A. By holding the stop 7 in place with the screw, the slide can not proceed further to the rear of the paddle board 5. Once the stop 7 is removed from the track 5, then the slide can be removed therefrom. To accomplish the goal of placing the stop 7 within the track 3, the stop 7 has upper 7A and lower 7B grooves along its top and bottom surface respectively, that match corresponding raised protrusions known as nodes 3C, 3D running the length of the inner surface of the top and bottom portions of the track respectively.

Figure 3C:
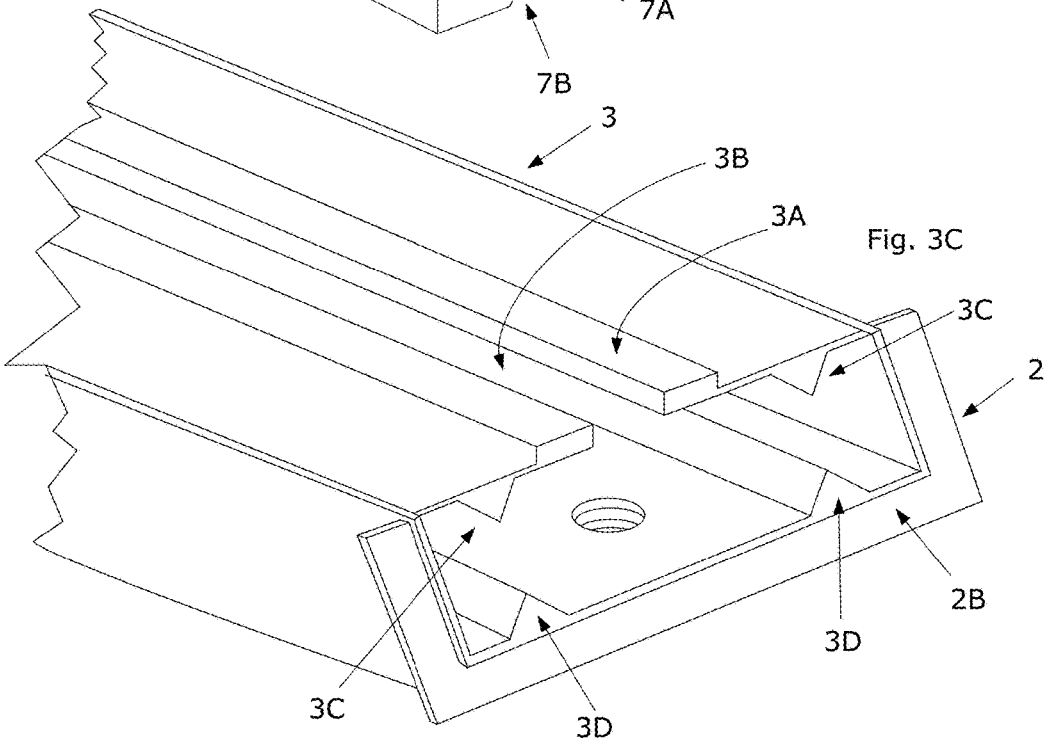
FIG. 3C presents a view of an end of the track having a hole for insertion of a screw for use with the stop of FIG. 3B.

FIG. 3C presents a view of an end of the track having a hole for insertion of a screw for use with the stop of FIG. 3B. The rear end cap 2 has been positioned and cemented under the rear end of the track 3. In this view one can see raised protrusions known as nodes 3C, 3D running the length of the inner surface of the top and bottom portions of the track respectively. Further, the slot 3B between two flanges 3A is clearly shown.

Figure 4A:
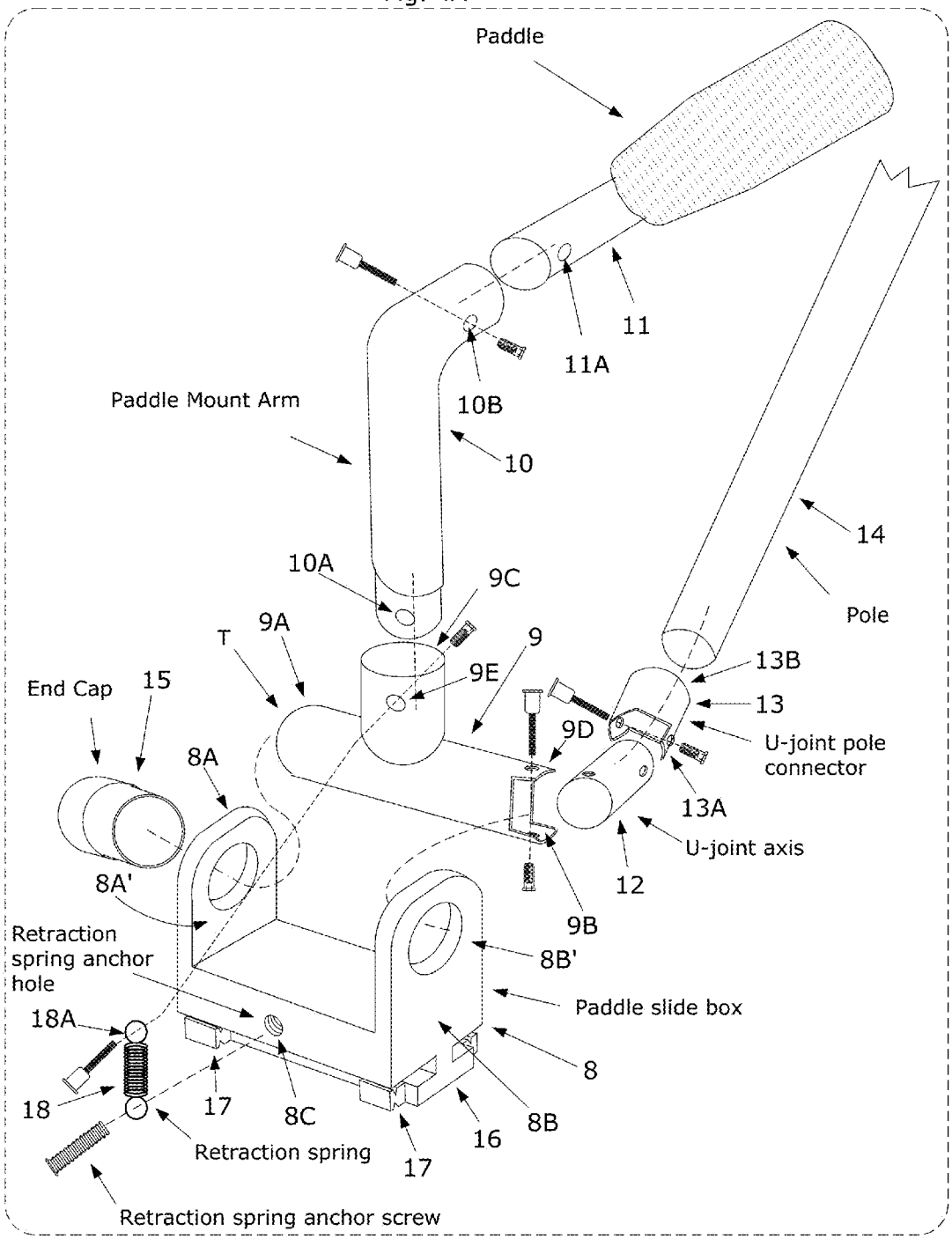
FIG. 4A presents a view of a slide attached to a paddle and to a pole having an actuator system as utilized in a Supski Paddle System as taught in an embodiment disclosed herein.

FIG. 4A presents a view of a slide attached to a paddle and to a pole having an actuator system as utilized in a Supski Paddle System as taught in an embodiment disclosed herein. A slide 8 translates down the track 3 shown in FIG. 1A, 1B, 2A, 2B, 3C using lateral protrusions having indentations that match the nodes 3C, 3D described previously with respect to FIG. 2A, 3C. The slide 8 forms the core of the moveable portion of the Suspski Paddle System as it translates atop the track nodes 3C, 3D and is attached indirectly to a paddle 11 and to a pole 14.

The slide has an inverted T shaped protrusion 16 starting from just underneath the first vertically shaped arm 8A until it reaches the underside of the second vertically shaped arm 8B. At the outermost edges of the horizontal T top portion (now riding upside down) of the T shaped protrusion 16 that has been inverted, slide mounts 17 extend outwards laterally from both the right and left sides of the slide; each of these slide mounts 17 has a top and bottom groove 17A for riding atop nodes 3C, 3D respectively. Continuing the discussion of the attachments to the slide 8, it should be understood that the pole 14 is moved about by user hand action having corresponding reactions in the position of the paddle because of a rotational interplay there between through an axle 9 that rotates within circular orifices 8A', 8B'. These orifices 8A', 8B' are located within vertically raised arms 8A, 8B (rear, forward) that extend upward on the slide 8.

Axle 9 is T-shaped tubular device having a rear end 9A and a forward end 9B forming the horizontal top portion of the T (inverted in figure) as well as a central tube 9C extending out from the center thereof forming the center downwards leg of the T (upwards in figure). The rear end 9A is inserted within the rear orifice 8A whilst the forward end 9B is inserted within the forward orifice 8B. An end cap 15 has a narrow neck 15A that is inserted snugly and cemented with glues so that the large portion of the end cap 15 prevents axle 9 and end cap 15 from being released from the slide 8. The forward end 9B of the axle 9 has a first set of two pincers 9D extending out parallel to each other and to the body of axle 9 at this point used to connect the forward end 9B to (U joint axis) axis 12. Axis 12 is a hollow tube that facilitates motion of the paddle 11 and pole 14.

In order to accomplish this, each pincer 9D has a hole in it for insertion of either a connecting bolt or a corresponding connecting nut through opposing holes whereupon they enter similar holes in the body of the axis 12 near a first end thereof that correspond positionally to the holes of each pincer 9D. It should be apparent that the axis 12 is located at this point between the pincers 9D. The axis 12 has similar holes near its other end that similarly are engaged by a second set of pincers 13A that extend out of one end of (U Joint Pole) connector 13 and are parallel to thereto.

As before, each pincer 13A has a hole in it for insertion of either a connecting bolt or a corresponding connecting nut through opposing holes whereupon they enter similar holes in the body of the axis 12 near a second end thereof that correspond positionally to the holes of each pincer 13A. It should be apparent that the axis 12 is located at this point between the pincers 13A. Connector 13 has an open end 13B by which pole 14 can be inserted therein and affixed thereto with cement or fasteners.

Central tube 9C of the axle 9 has an open distal end that has a corresponding narrow end of a paddle mount arm 10 inserted therein. There are two holes 9E near central tube 9C distal end for insertion of a connecting bolt or a corresponding connecting nut through opposing holes whereupon they enter two similar holes 10A at opposing sides of the corresponding narrow end of a paddle mount arm 10. A similar connecting system is used to connect paddle 11 using two opposing holes 11A at an end of the paddle in a narrow tube thereof into a tube of a wider bent end of the paddle mount arm having corresponding holes 10B. Insertion of a connecting bolt or a corresponding connecting nut through holes 11A and corresponding holes 10B serve to engage the aforementioned and lock the paddle 11 in place with the paddle mount arm.

Finally, a retraction spring 18 has two end attachment loops 18A. A first loop 18A is attached using a retraction spring anchor screw in a threaded hole 8C in a side of the slide 8. A second loop 18A is attached by wrapping about the connecting bolt and nut system in the closest hole 9E within central tube 9C described above associated with holes 9E. This spring provides a retraction mechanism whereby the paddle retracts under the action of spring 18 thereby forcing the paddles out of the water.

Figure 4B:
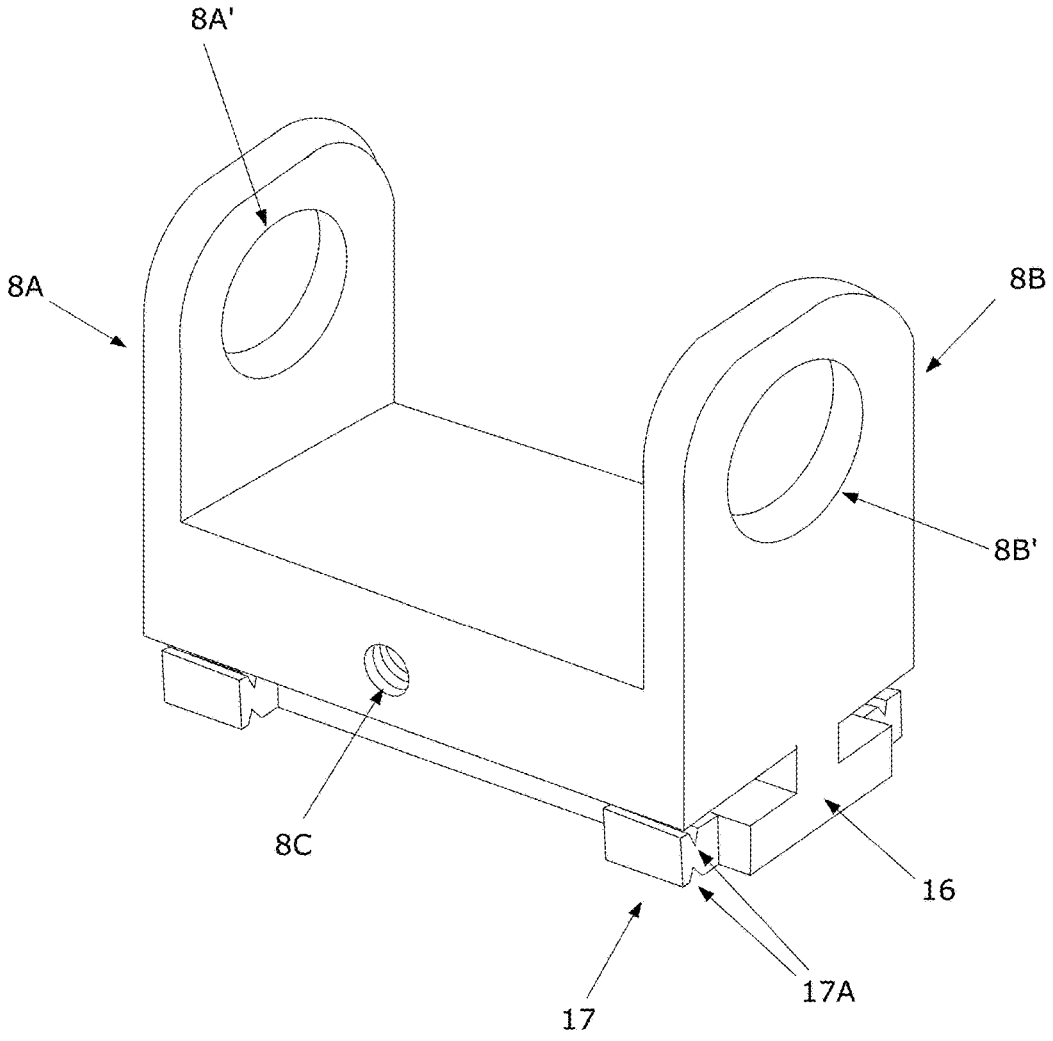
FIG. 4B presents a view of the slide 8 showing in closeup various features thereof as described in an embodiment herein disclosed.

FIG. 4B presents a view of the slide 8 showing in closeup various features thereof as described in an embodiment herein disclosed. The slide has an inverted T shaped protrusion 16 starting from just underneath the first vertically shaped arm 8A until it reaches the underside of the second vertically shaped arm 8B. At the outermost edges of the horizontal T top portion (now riding upside down) of the T shaped protrusion 16 that has been inverted, there are integral slide mounts 17. These slide mounts 17 (protrusions) extend outwards laterally from both the right and left sides of the slide; each of these slide mounts 17 has a top and bottom groove 17A for riding atop nodes 3C, 3D respectively. There are four slide mounts 17 shown two to a side though fewer or more are contemplated depending on the needs of the implementation.

Figure 4C:
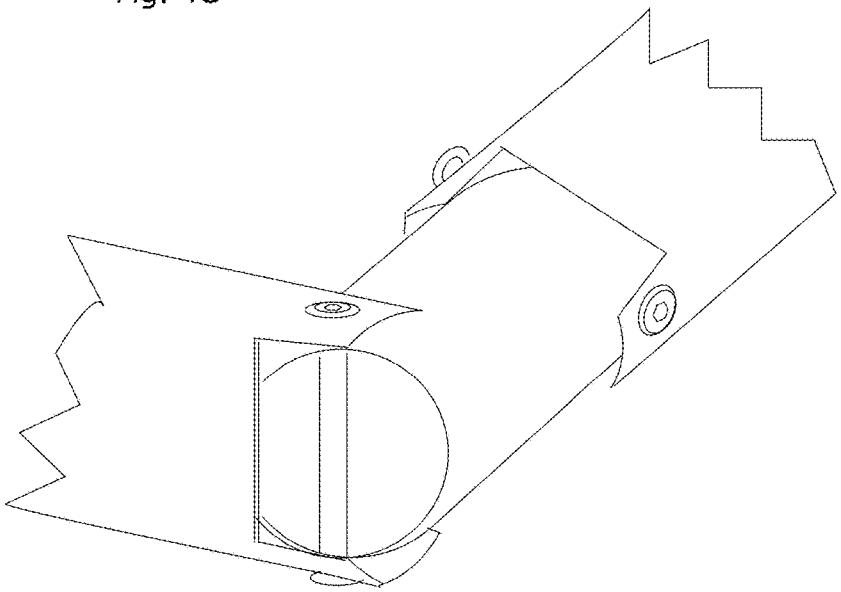
FIG. 4C presents an assembled view of a section of axle 9 connected to an axis 12 and a pole connector 13 as described in an embodiment herein disclosed.

FIG. 4C presents an assembled view of a section of axle 9 connected to an axis 12 and a pole connector 13 as described in an embodiment herein disclosed.

Figure 4D:
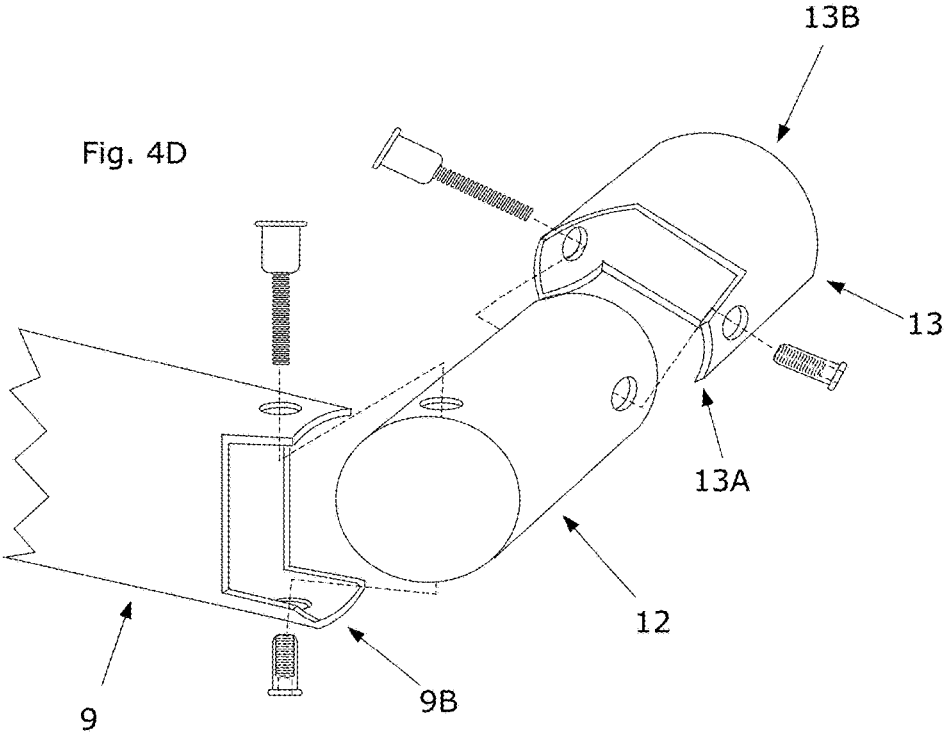
FIG. 4D presents disassembled view of a section of axle 9 connected to an axis 12 and a pole connector 13 as described in an embodiment herein disclosed.

FIG. 4D presents disassembled view of a section of axle 9 connected to an axis 12 and a pole connector 13 as described in an embodiment herein disclosed.

Figure 4E:
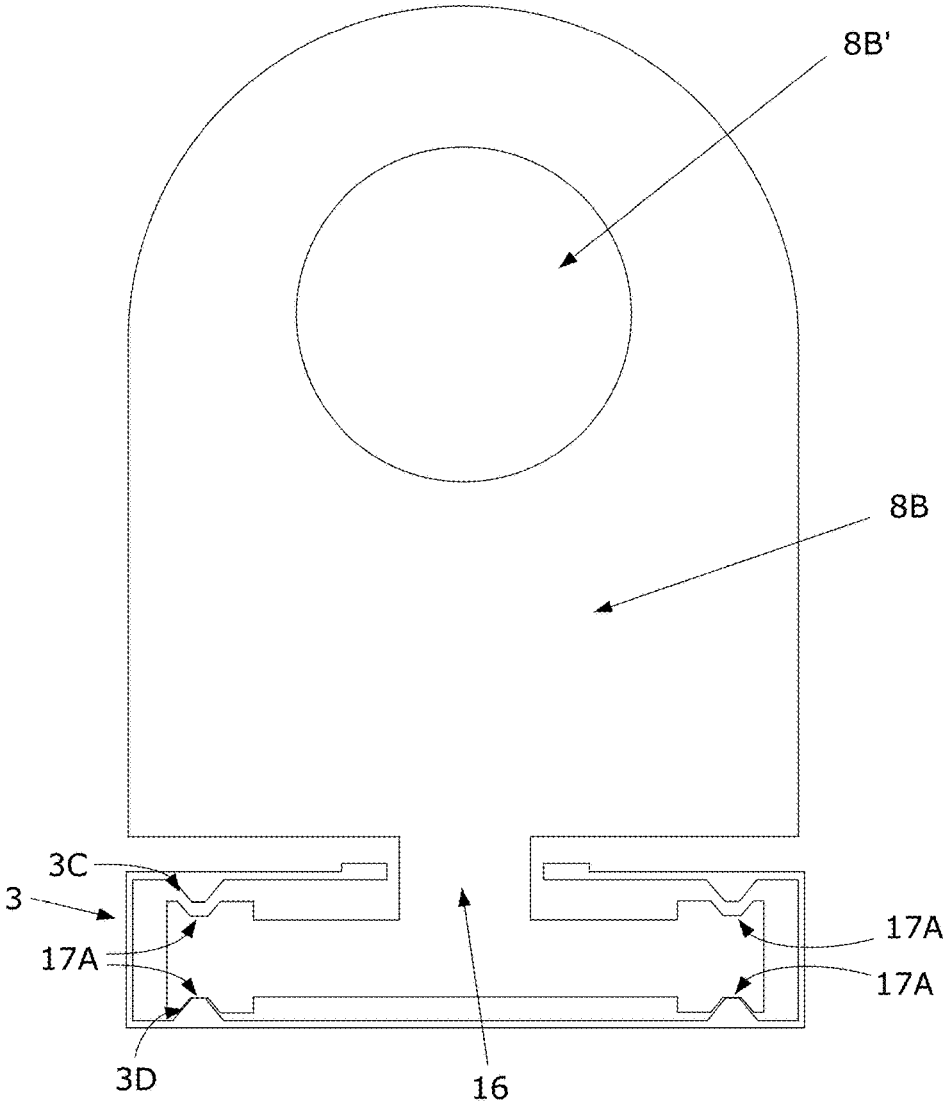
FIG. 4E presents a forward view looking backwards of a slide having its inverted T shaped protrusion 16 having been inserted within track 3 so that the track nodes 3C, 3D serve as guideways for the grooves 17A in slide mounts 17 as in an embodiment herein disclosed.

FIG. 4E presents a forward view looking backwards of a slide having its inverted T shaped protrusion 16 having been inserted within track 3 so that the track nodes 3C, 3D serve as guideways for the grooves 17A in slide mounts 17 in an embodiment herein disclosed.

Figure 4F:
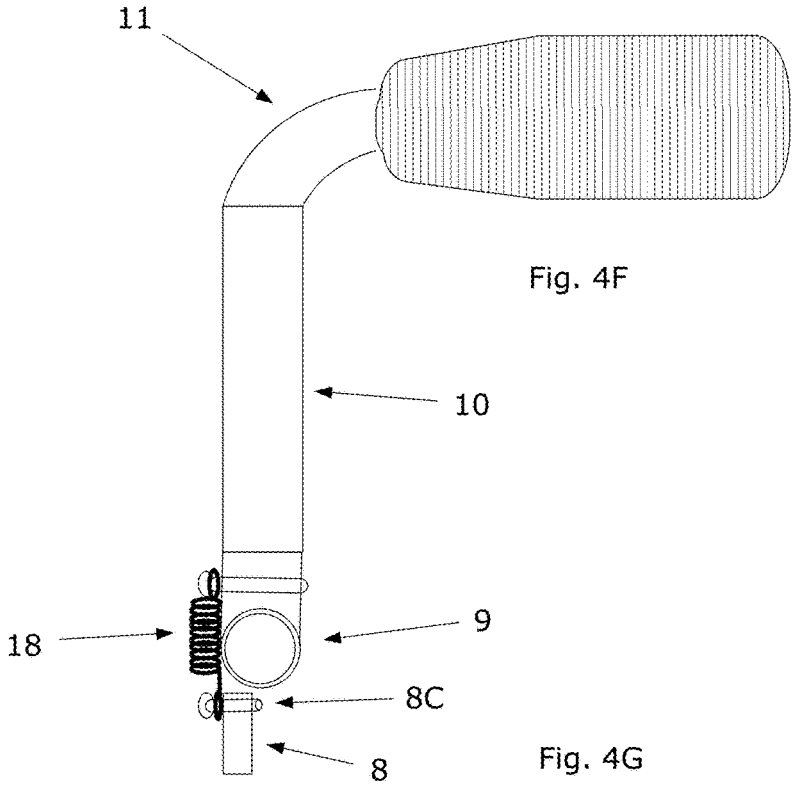
FIG. 4F presents a view of how the spring 18 is in its rest raised position whilst
Figure 4G:
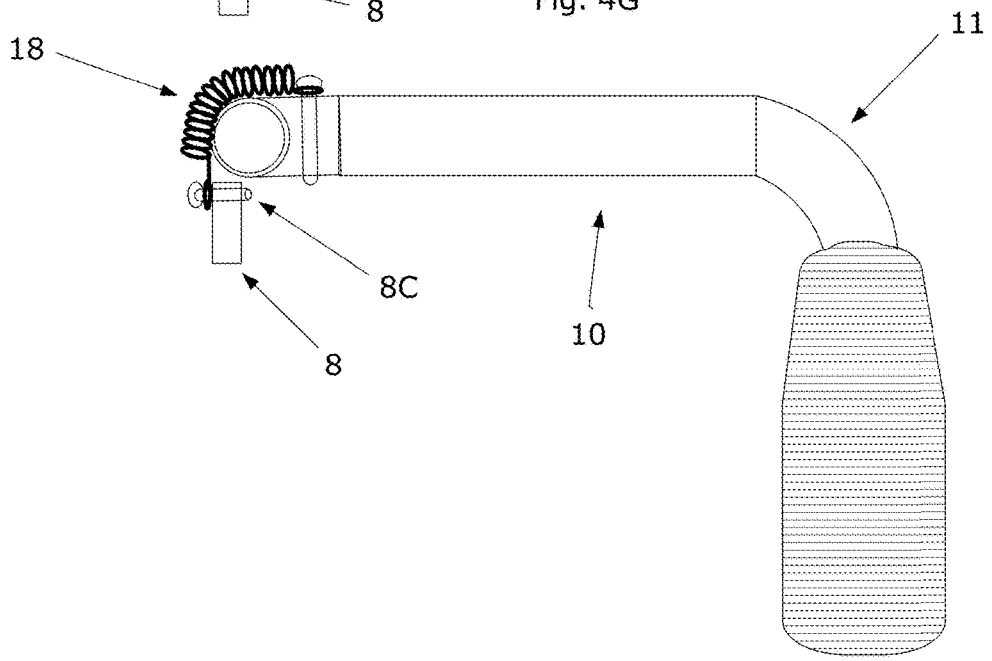
FIG. 4G presents a view of when the spring 18 is extended by user interaction with poles as the poles are placed in the water.

FIG. 4F presents a view of how the spring 18 is in its rest raised position whilst FIG. 4G presents a view of when the spring 18 is extended by user interaction with poles as the poles are placed in the water.

Figure 4H:
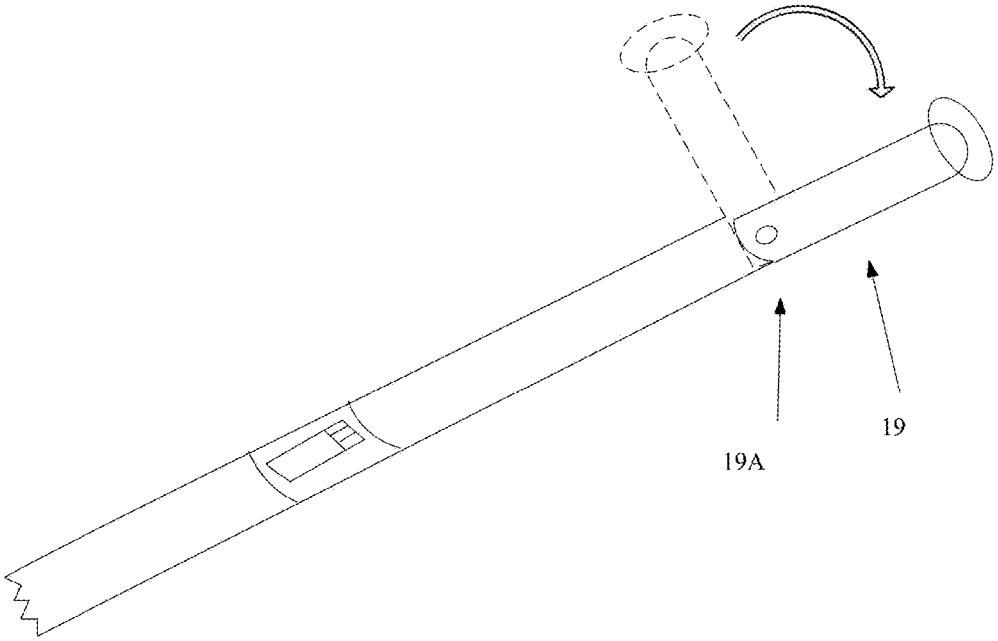
FIG. 4H presents a view of a hinged grip 19 attached to a pole where the grip 19 is moveable along the hinge 19A.
Figure 4I:
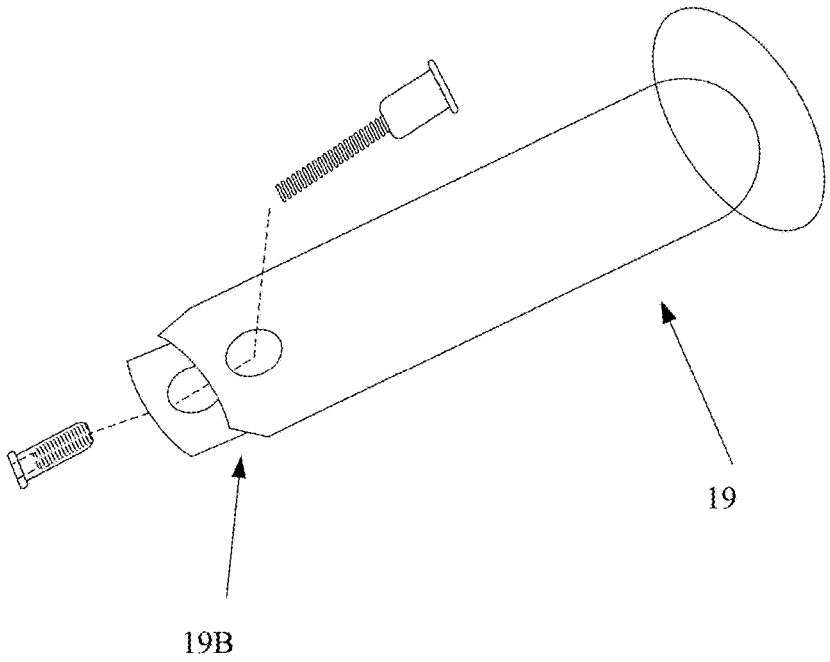
FIG. 4I presents a view of the grip 19 having two holes 19B within two parallel protrusions extending out of the grip 19 at an end thereof; these are for insertion of a connection bolt and connecting nut making the axle portion of the hinge 19A whilst the protrusions/holes are the attachment portion of the hinge 19A using connection bolt and connecting nut to corresponding pole holes for movable engagement therewith between the pole and the grip 19.

FIG. 4H presents a view of a hinged grip 19 attached to a pole where the grip 19 is moveable along the hinge 19A. FIG. 4I presents a view of the grip 19 having two holes 19B within two parallel protrusions extending out of the grip 19 at an end thereof; these are for insertion of a connection bolt and connecting nut making the axle portion of the hinge 19A whilst the protrusions/holes are the attachment portion of the hinge 19A using connection bolt and connecting nut to corresponding pole holes for movable engagement therewith between the pole and the grip 19.

Figure 5A:
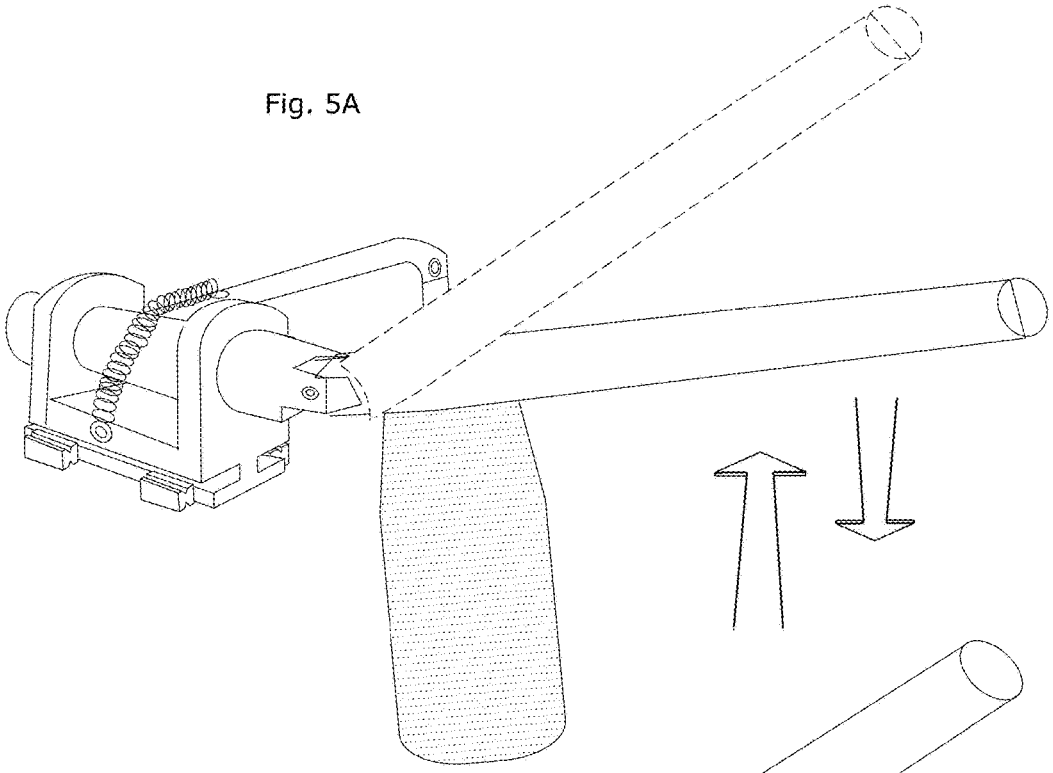
FIG. 5A presents a view of how the movable connection between components 9, 12-13 permit the up and down movement of paddles through user interaction with a pole in an embodiment disclosed herein.

FIG. 5A presents a view of how the movable connection between components 9, 12-13 permit the up and down movement of paddles through user interaction with a pole in an embodiment disclosed herein.

Figure 5B:
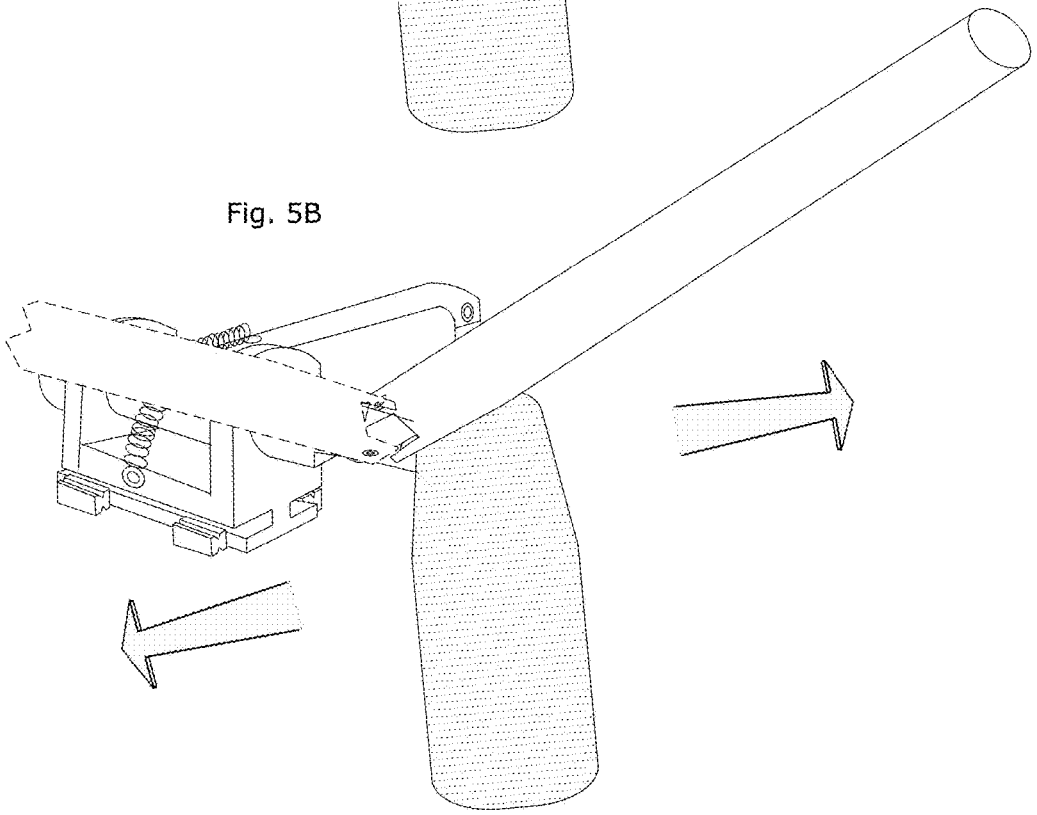
FIG. 5B presents a view of how the movable connection between components 9, 12-13 permit the side to side movement of paddles through user interaction with a pole in an embodiment disclosed herein. The side to side motion assists in moving the slide 8 up and down the track.

FIG. 5B presents a view of how the movable connection between components 9, 12-13 permit the side to side movement of paddles through user interaction with a pole in an embodiment disclosed herein. The side to side motion assists in moving the slide 8 up and down the track.

Figure 5C:
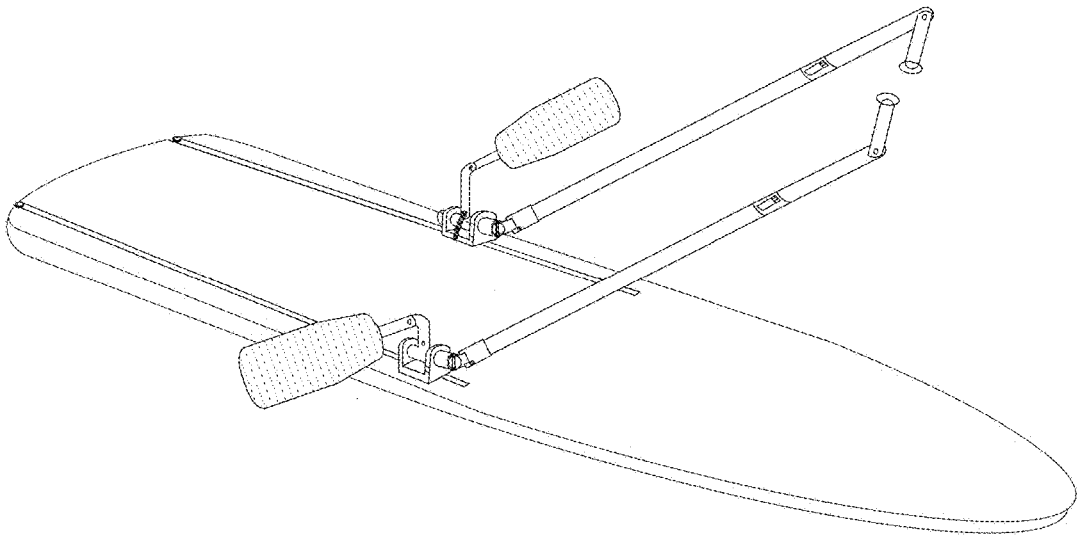
FIG. 5C presents a view of a complete SUPSKI PADDLE SYSTEM including a board paddles, user pole, slide and other components in an embodiment disclosed herein.

FIG. 5C presents a view of a complete SUPSKI PADDLE SYSTEM including a board paddles, user pole, slide and other components in an embodiment disclosed herein. Some useful points on the system include the following:

Hinged grips allow user to rotate poles 90 degrees and then extend backward through the track.

The paddle rotates 90 degrees to enter the water when poles are rotated. Retraction springs pulls paddle out of water when rotation pressure applied to poles is released. This gives user an assist when returning pole paddle system to starting position.

The u-joint axis allows for poles to move up and down and side to side as rotational pressure is applied and the slide moves back and forth through the track.

A pole lock optionally allows a user to change the height of the pole up and down as needed.

Figure 5D:
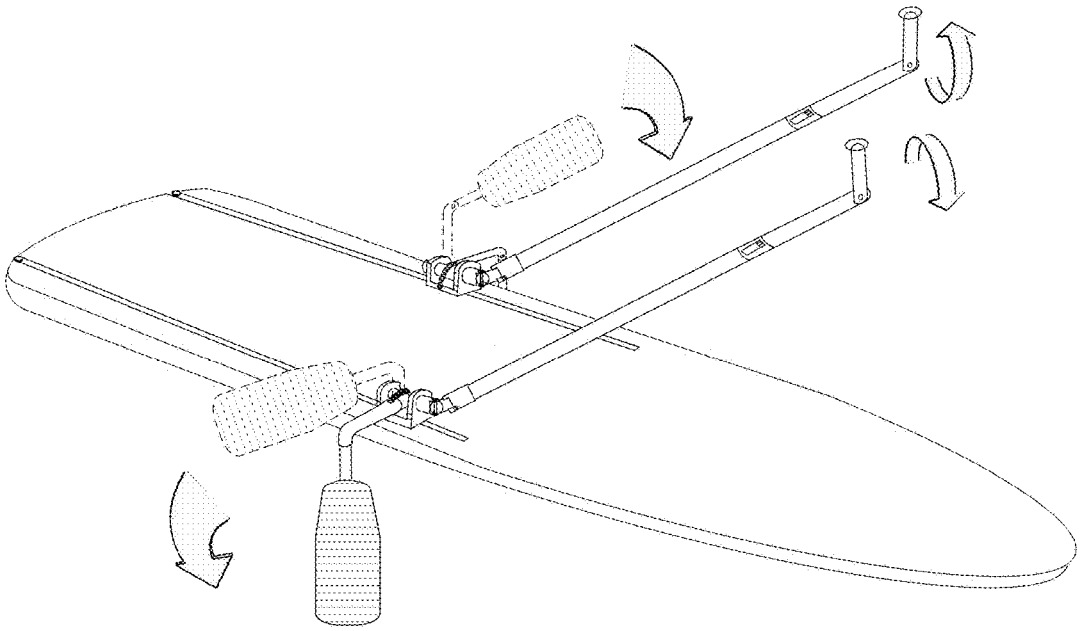
FIG. 5D presents a view of the paddles being moved into the water in an embodiment disclosed herein.

FIG. 5D presents a view of the paddles being moved into the water in an embodiment disclosed herein. A user rotates the poles 90 degrees which is counter clockwise on left side and clockwise on right side; as a result, the paddles rotate 90 degrees and enter the water (these motions are from the perspective of the rear of the board looking forward). The user would next push the poles backwards past the hips giving forward propulsion to the paddle board. This action is the same as is used in cross country skiing for the upper torso only.

Figure 5E:
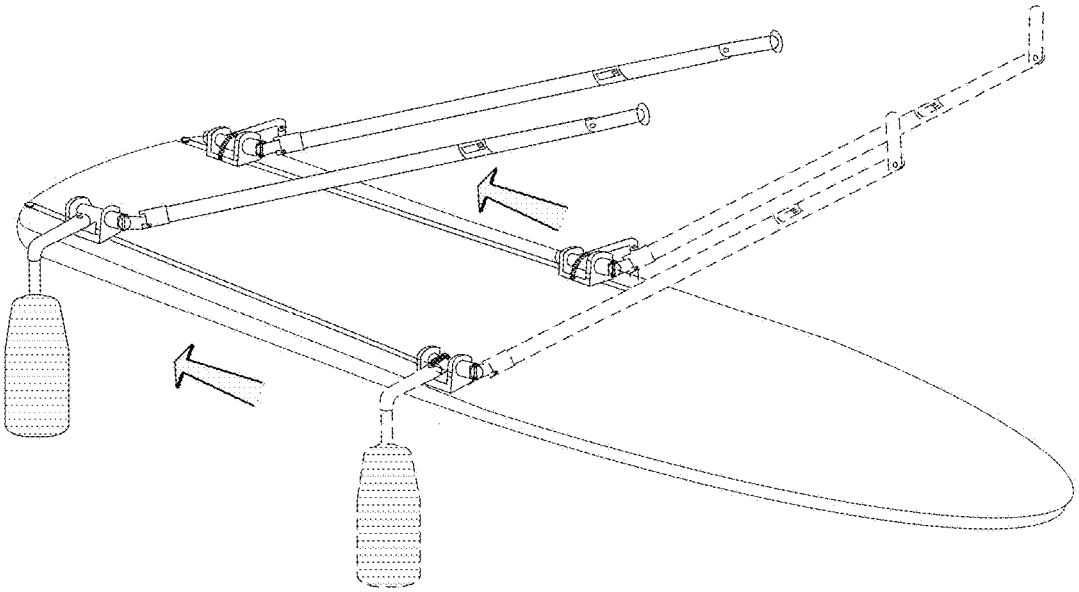
FIG. 5E presents a view of the poles, paddle and slide being moved backwards from a starting position to an end position after the stroke as the paddles move water and thereby move the board forward in an embodiment disclosed herein.

FIG. 5E presents a view of the poles, paddle and slide being moved backwards from a starting position to an end position after the stroke as the paddles move water and thereby move the board forward in an embodiment disclosed herein. At the beginning of the stroke the grips are rotated on their respective hinges and at the stroke end they are parallel to the pole which is shown separately in FIG. 5F.

Figure 5F:
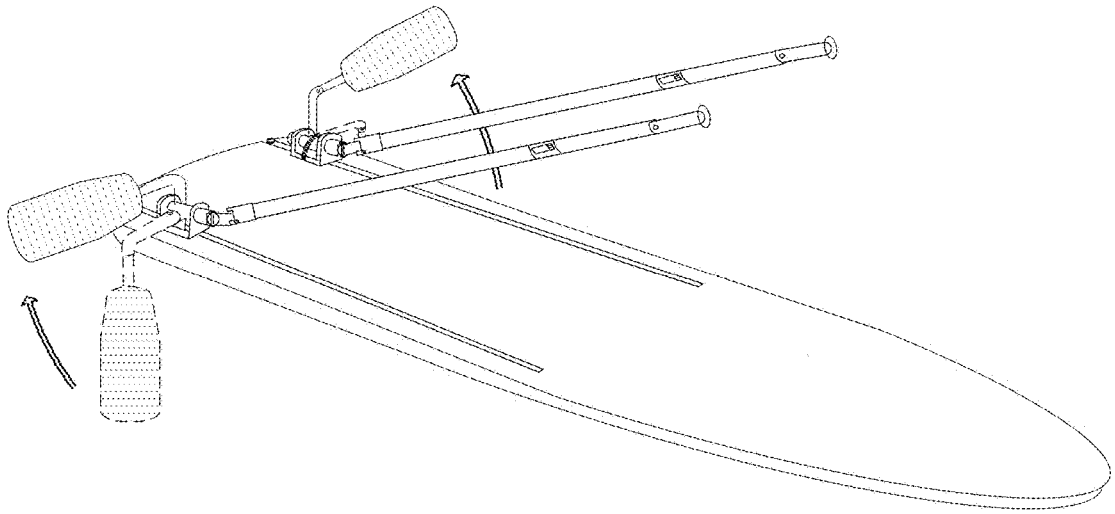
FIG. 5F presents a view of the end of the stroke where the hand grips are parallel to the pole in an embodiment disclosed herein.

FIG. 5F presents a view of the end of the stroke where the hand grips are parallel to the pole in an embodiment disclosed herein. In this position the rotational action of the u joint causes the paddles to act under the influence of the spring which causes them to exit the water.

Figure 5G:
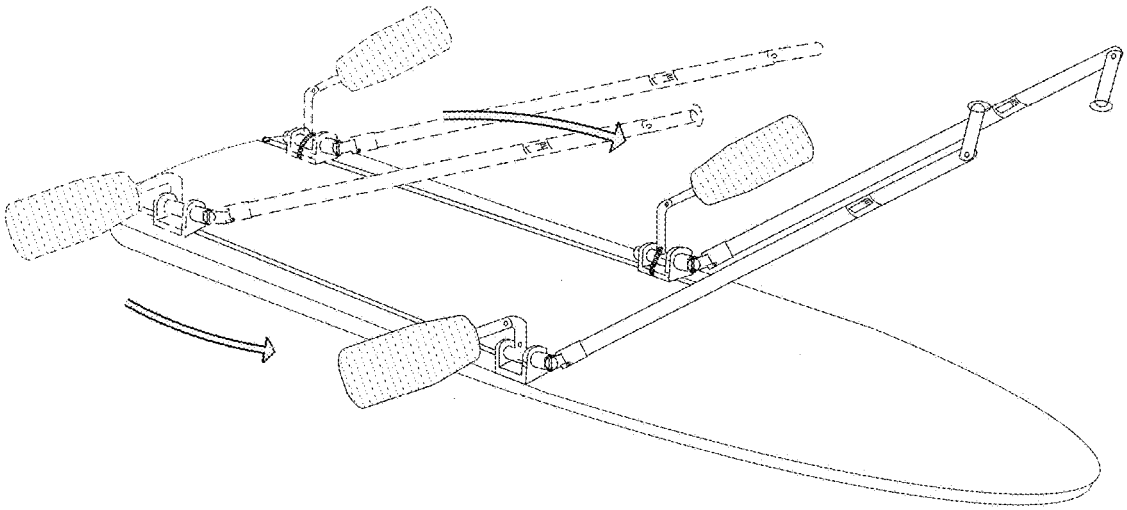
FIG. 5G presents a view the poles, paddles, slide and other components being moved from the rear of the board forward to a starting position in an embodiment disclosed herein.

FIG. 5G presents a view the poles, paddles, slide and other components being moved from the rear of the board forward to a starting position in an embodiment disclosed herein.

Figure 5H:
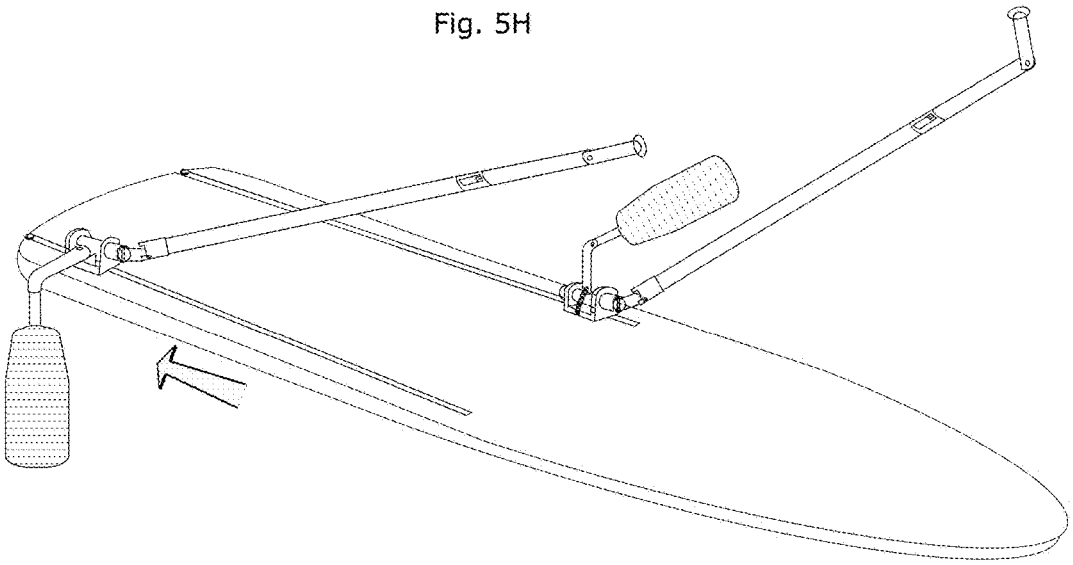
FIG. 5H-5I presents views of alternate strokes from one side to another in an embodiment disclosed herein.
Figure 5I:
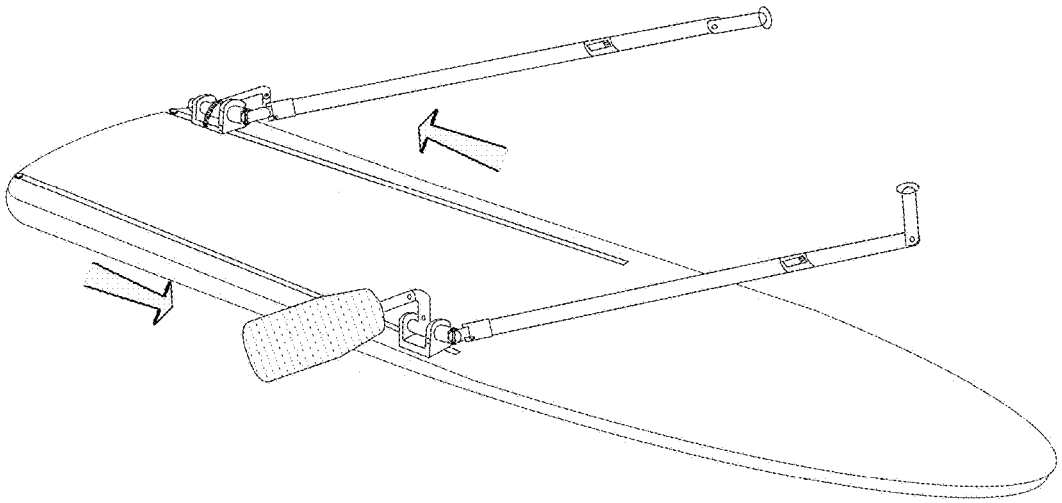

FIG. 5H-5I presents views of alternate strokes from one side to another in an embodiment disclosed herein. A user alternates pushing back on one side whilst holding the other side paddle out of the water. At the end of the stroke the user then commences a stroke on the opposite side. The opposing paddle is pulled to the forward starting position at the same time. This mirrors the stroke method of cross country skiing.

Figure 5J:
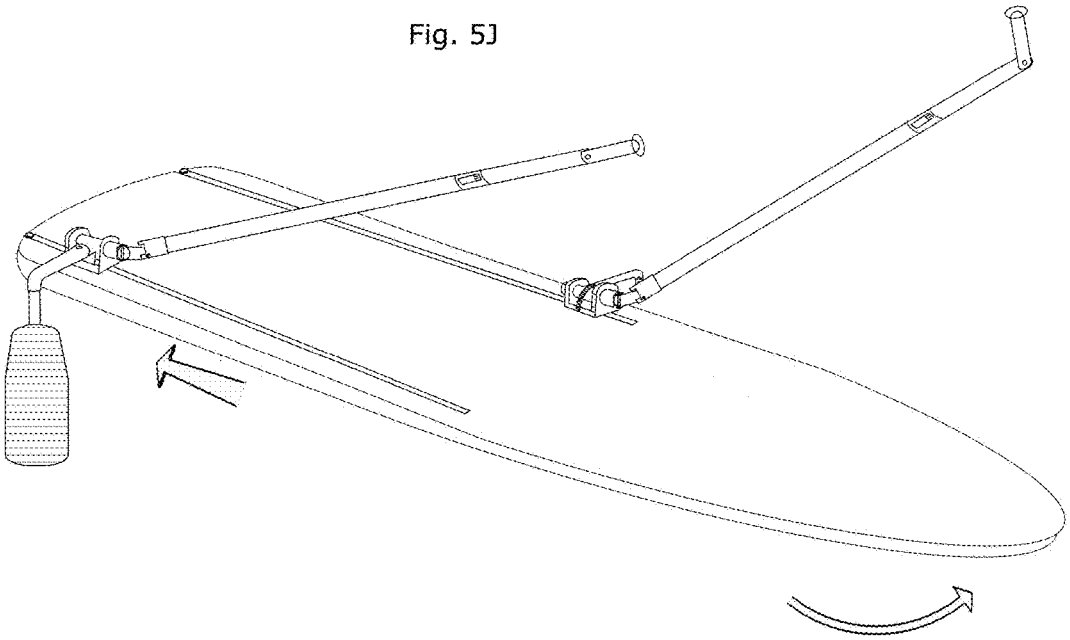
FIG. 5J-5K shows a view of a turns accomplished by holding one's side paddle locked in a down position (paddle in the water) and applying a stroke to the opposite side.
Figure 5K:
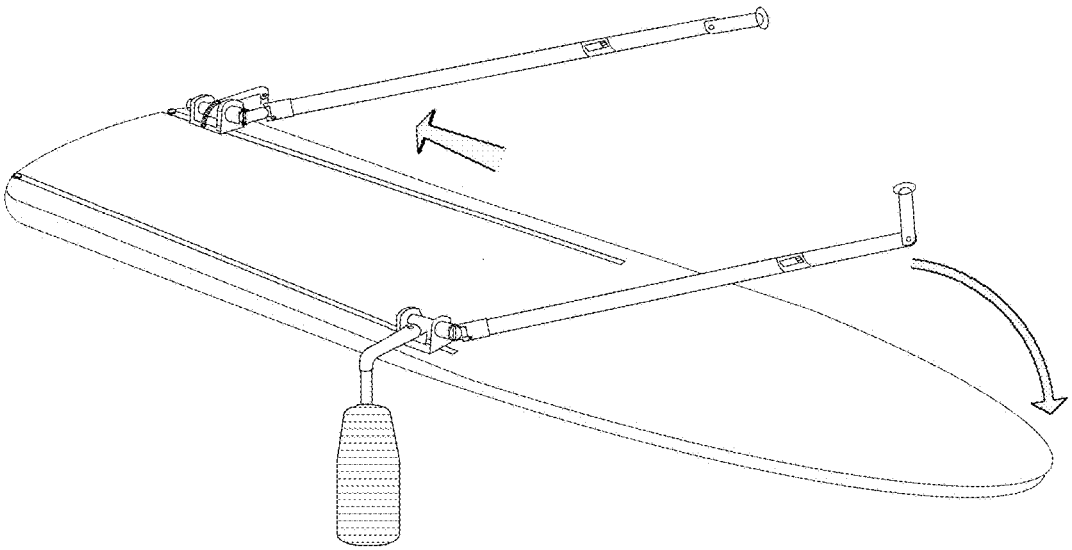

FIG. 5J-5K shows a view of a turns accomplished by holding one's side paddle locked in a down position (paddle in the water) and applying a stroke to the opposite side. FIG. 5J shows a left turn whilst FIG. 5K shows a right turn.

Figure 5L:
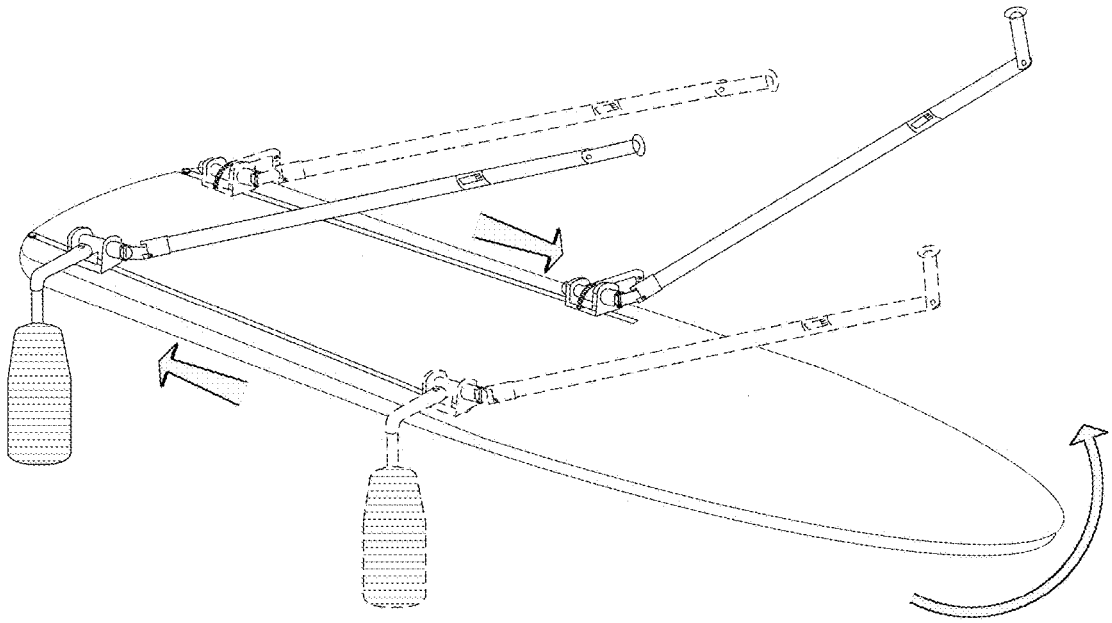
FIG. 5L presents a view of a circular motion of a board in an embodiment disclosed herein.

FIG. 5L presents a view of a circular motion of a board in an embodiment disclosed herein. Here one pole is pulled forward on one side with the paddle in the water whilst pushing the other side to the back with its paddle in the water; thus, a user can turn the board in circles.

Figure 5M:
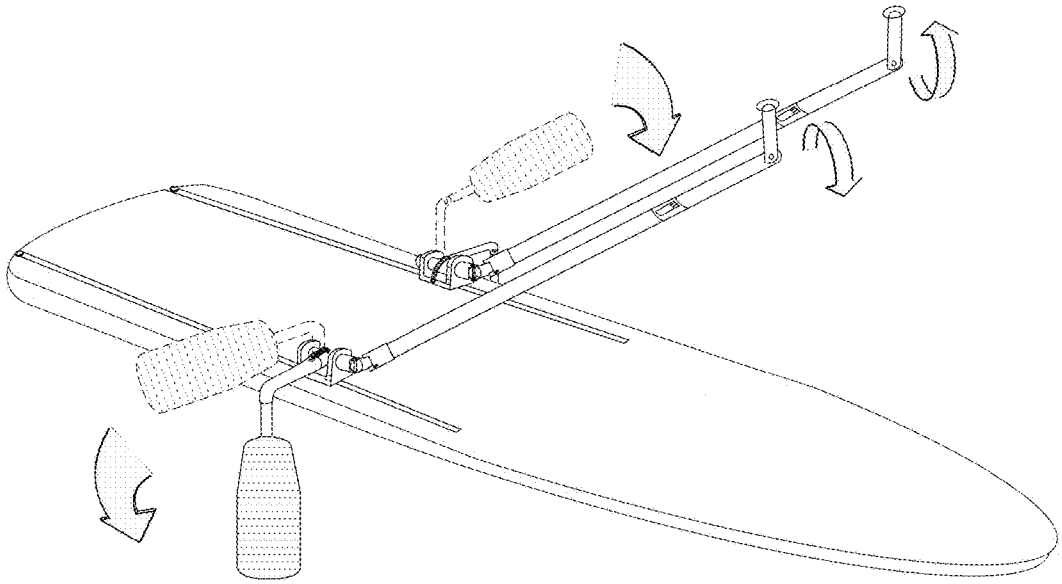
FIG. 5M presents a view of stopping the board by placing both paddles in the water.

FIG. 5M presents a view of stopping the board by placing both paddles in the water.

Figure 5N:
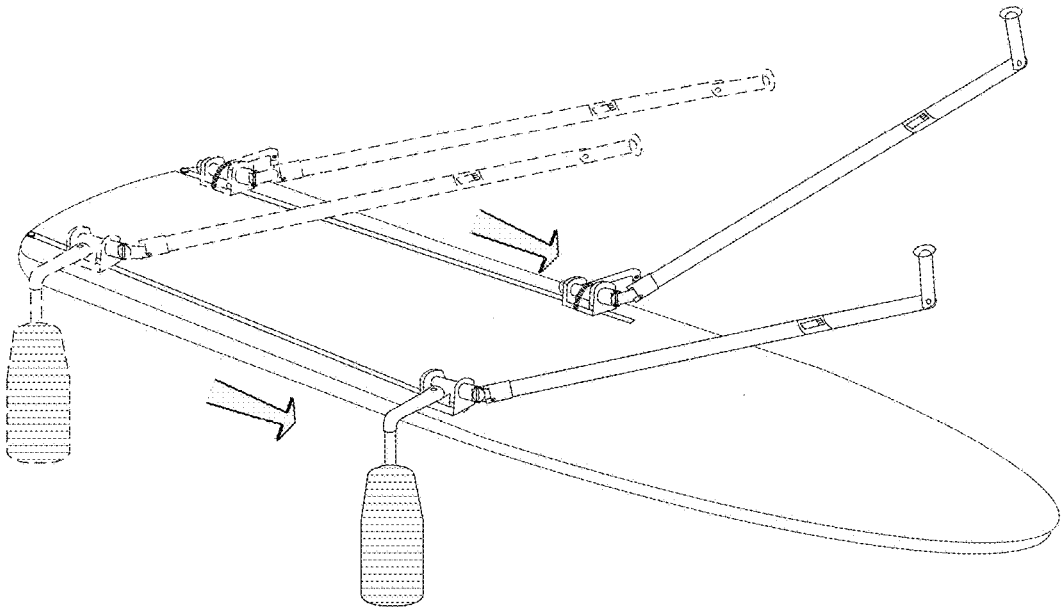
FIG. 5N presents a view of moving in reverse where the user pulls both polls forward with the paddles in the water.

FIG. 5N presents a view of moving in reverse where the user pulls both polls forward with the paddles in the water.

It should be apparent that appropriate rotation of the poles causes a first rotation of the connector 13, axis 12, and axle 9 so as to place the paddles in the water. Similarly, second rotation of the aforementioned in a direction opposite the first rotation cause the paddles to be removed from the water. This rotational action is opposite depending upon whether you are using the right pole, paddle, slide or using the left pole, paddle, slide. For a left side first rotation, the pole is moved clockwise (from the perspective of the front of the board looking backwards); this forces the paddle into the water and extends the retraction spring thereby creating tension therein. To remove the paddles from the water on the left side one would turn the pole counterclockwise thereby extracting it therefrom and receiving assistance from the retraction spring to remove it from the water.

For a right side first rotation, the pole is moved counterclockwise (from the perspective of the front of the board looking backwards); this forces the paddle into the water and extends the retraction spring thereby creating tension therein. To remove the paddles from the water on the left side one would turn the pole clockwise thereby extracting it therefrom and receiving assistance from the retraction spring to remove it from the water.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. An exercise system comprising:

a paddle board having a track attached thereto wherein the track has an integral longitudinal protrusion running down an inside surface of the track; and, the longitudinal protrusion is disposed on an inside lower surface of the track.

2. A paddleboard assembly comprising:

a track integrally formed from a board having a lengthwise first node running down a recessed inner surface;

a slide inserted within the track having a first integral lateral mounting protrusion; and a first depression in the first integral mounting protrusion associated with and matching the lengthwise first node of the recessed inner surface of the track.

3. The paddle board assembly of claim 2, wherein the slide further comprises:

a lengthwise second node running down a recessed inner surface parallel to the first node.

4. The paddle board assembly of claim 3, further comprising:

the slide having a second integral lateral mounting protrusion having a second depression associated with and matching the lengthwise second node of the recessed inner surface of the track.

5. The paddle board assembly of claim 3, further comprising:

a paddle drive rotationally attached to a slide;

a pole attached to the paddle drive;

a paddle attached to the paddle drive;

a spring attached to the paddle drive and to the slide.

6. An activity paddle board comprising:

a board loaded with a first track; such that the first track has a first slide mounted therein using at least two lateral mounts atop a first and a second raised portion of the first track respectively;

a paddle attached to the first slide through a rotational member associated with the slide and a pole.

* * * * *